US006976427B2

(12) United States Patent
Becker et al.

(10) Patent No.: US 6,976,427 B2
(45) Date of Patent: Dec. 20, 2005

(54) GRIPPER SYSTEM

(75) Inventors: Willi Becker, Bammental (DE); Jens Forche, Freinsheim (DE); Hans-Peter Hiltwein, Waghäusel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 45 days.

(21) Appl. No.: 10/700,119

(22) Filed: Nov. 3, 2003

(65) Prior Publication Data

US 2004/0094056 A1 May 20, 2004

(30) Foreign Application Priority Data

Nov. 7, 2002 (DE) ..... 102 51 800

(51) Int. Cl.[7] ..... B41F 1/30

(52) U.S. Cl. ..... 101/408; 101/230; 101/409; 271/277

(58) Field of Search ..... 101/229, 230, 101/408, 409; 271/275, 276, 277

(56) References Cited

U.S. PATENT DOCUMENTS

| | | | |
|---|---|---|---|
| 4,697,512 | A | 10/1987 | Simeth |
| 4,700,626 | A | 10/1987 | Iwamoto et al. |

FOREIGN PATENT DOCUMENTS

| | | |
|---|---|---|
| CH | 341840 | 12/1959 |
| DE | 1 234 738 | 2/1967 |
| DE | 34 45 886 A1 | 6/1986 |
| DE | 36 05 523 A1 | 8/1987 |
| EP | 1 057 626 A1 | 12/2000 |
| GB | 791911 | 3/1958 |

*Primary Examiner*—Ren Yan
(74) *Attorney, Agent, or Firm*—Laurence A. Greenberg; Werner H. Stemer; Ralph E. Locher

(57) ABSTRACT

In a gripper system having grippers disposed in a row and interspaces between the grippers and hold-downs for holding down in each case a free edge of a printing material sheet gripped by the grippers, the hold-downs being disposed to project into the interspaces and being mounted such that they can be displaced together with the grippers when gripping the printing material sheet.

19 Claims, 4 Drawing Sheets

GRIPPER SYSTEM

BACKGROUND OF THE INVENTION

Field of the Invention

The present invention relates to a gripper system having grippers disposed in a row and interspaces between the grippers, and having hold-downs for holding down in each case a free edge of a printing material sheet gripped by the grippers and produced against the background set forth in the following text.

The problem with such systems is that only in the case of specific sheet widths is the corner of the printing material sheet that is clamped in located exactly under one of the grippers. In the case of many other sheet formats, the sheet projects laterally beyond the gripper that is involved in gripping the sheet as the last one within the row of grippers. In such a case, the sheet has what is referred to as a free corner, which is located in the area of one of the interspaces. The free corner of the sheet is located between the last-named gripper and the gripper adjacent to this gripper, which is already located outside the format width and, therefore, is not directly involved in gripping the sheet. The further the sheet projects freely into the interspace and the more flexible the sheet material is and the higher the transport speed of the gripper system is, the more the free corner of the sheet tends to break out from its correct flat position. Because of its uncontrolled escape, the corner of the sheet can collide with a further gripper system shortly before the latter picks up the sheet from the first-named gripper system. As a result of such a collision with the corner of the sheet, the latter can be bent over or compressed, which means that the further processing of the sheet can become more difficult or even completely impossible and the sheet can become a reject. To avoid such a disruption, various technical measures have already been considered.

For example, German Published, Non-Prosecuted Patent Application DE 1 23 47 38 B describes a first gripper system whose grippers interact with hold-downs that are disposed on a second gripper system. The second gripper system has grippers that interact with hold-downs that are disposed on the first gripper system. The hold-downs of each of the two gripper systems, therefore, interact with the grippers of the respective other gripper system during the transfer of the sheet from the first to the second gripper system. According to one embodiment described in the aforementioned publication, the hold-downs are constructed as rolls and rotatably mounted in the gripper pads of the respective gripper system.

A gripper system described in European Patent Application 1 057 626 A1, in which extendable sheet supports are disposed in the regions of the interspaces between the stationary gripper pads, merely represents further art. By these sheet supports, the edge of the sheet is supported in the interspaces and stabilized in its flat position. As a result, the formation of creases and the bending over of the corners of the sheet in the case of projecting sheet formats are avoided.

SUMMARY OF THE INVENTION

It is accordingly an object of the invention to provide a gripper system that overcomes the hereinafore-mentioned disadvantages of the heretofore-known devices of this general type and by which the printing material sheets of all sheet formats lying between a minimum sheet format and a maximum sheet format may be transported equally securely.

With the foregoing and other objects in view, there is provided, in accordance with the invention, a gripper system, including grippers disposed in a row, the grippers defining interspaces therebetween and having hold-downs for respectively holding down a free edge of a printing material sheet gripped by the grippers, the hold-downs being disposed to project into the interspaces and being mounted to adjust together with the grippers when gripping the printing material sheet.

A gripper system according to the invention is characterized in that the hold-downs are disposed to project into the interspaces and are mounted such that they can be adjusted together with the grippers when gripping the printing material sheets.

In the gripper system according to the invention, the grippers and the hold-downs associated with these grippers are, therefore, located on one and the same gripper system. Each of the hold-downs extends at least partly in the region of one of the interspaces in each case. The hold-downs of the gripper system according to the invention are mounted such that, when the grippers are opened and closed, they necessarily also carry out their movements. The free corner of the printing material sheet clamped in within the gripper system according to the invention is not only secured briefly against breaking out during the sheet transfer, by the hold-down that is currently effective in the respective case, but also during the entire time during which the printing material sheet is firmly held by the gripper system. Each of the hold-downs is used to hold down the free sheet edge of another sheet format.

Developments of the invention will be explained briefly below. In accordance with another feature of the invention the hold-downs are disposed directly on the grippers. Each of the hold-downs is, therefore, disposed on another of the grippers. Instead, provision could also be made for the hold-downs to be connected to the grippers by a gripper shaft that bears both the grippers and the hold-downs.

In accordance with a further feature of the invention, each of the hold-downs is formed in one piece together with one of the grippers in each case. Another of the hold-downs is, therefore, integrally molded on each of the grippers. Instead of this single-piece construction of the hold-downs and grippers, provision can also be made for each of the hold-downs to be fixed to one of the grippers in each case. In the last-named case, the hold-downs can be pins and inserted laterally into the grippers.

In accordance with an added feature of the invention, the sheet supporting surfaces of the hold-downs are disposed to be offset away from sheet clamping surfaces of the grippers in a direction at right angles to the row. The sheet supporting surfaces are, therefore, offset relative to the sheet clamping surfaces in a direction that is at right angles to the direction in which the row formed by the grippers and the interspaces extends.

In accordance with an additional feature of the invention, the sheet supporting surfaces and the sheet clamping surfaces are offset from one another in the manner of steps and the sheet supporting surfaces and sheet clamping surfaces determine planes that are substantially parallel to one another. The sheet supporting surface and the sheet clamping surface of each gripper-hold-down pair, therefore, together form a step, both the sheet supporting surface and the sheet clamping surface substantially being a flat surface and these two flat surfaces being aligned substantially parallel to each other.

With the objects of the invention in view, there is also provided a machine for processing printing material sheets having a first gripper system and a second gripper system, the two gripper systems being disposed to transfer and accept the printing material sheets from one to the other gripper system during sheet transfers, which machine is characterized in that the first and/or second gripper system of the machine is configured in accordance with the gripper system according to the invention or one of the developments of the latter.

Accordingly, the first and/or second gripper system includes grippers disposed in a row and interspaces between the grippers and also hold-downs for holding down a free edge of a printing material sheet gripped by the grippers, these hold-downs being disposed to project into the interspaces and being mounted such that they can be adjusted together with the grippers when gripping the printing material sheet.

In the case in which both the first gripper system and the second gripper system are configured accordingly, the hold-downs of the first gripper system can be disposed relative to the hold-downs of the second gripper system such that sheet supporting surfaces of the hold-downs of the first gripper system face sheet supporting surfaces of the hold-downs of the second gripper system during the sheet transfers. According to such a development, during each sheet transfer, the hold-downs of the first gripper system "travel around" the hold-downs of the second gripper system, and the latter "travel around" the hold-downs of the first gripper system, the sheet supporting surfaces of the first gripper system facing one side of the printing material sheet and the sheet supporting surfaces of the second gripper system facing the other side of the printing material sheet.

In accordance with a concomitant feature of the invention, in which the machine is, preferably, a sheet-fed printing press, the first gripper system, for example, in the form of a gripper bar, is a constituent part of a sheet transport drum or, instead, of a chain conveyor belonging to the machine and/or the second gripper system, for example, likewise in the form of a gripper bar, is a constituent part of a sheet transport drum or, instead, of a chain conveyor of the machine. Accordingly, the machine can include two sheet transport devices (sheet transport drum/sheet transport drum; chain conveyor/chain conveyor; sheet transport drum/chain conveyor) that interact directly during the transfer of the printing material sheets and of which one includes the first gripper system and the other the second gripper system.

Other features that are considered as characteristic for the invention are set forth in the appended claims.

Although the invention is illustrated and described herein as embodied in a gripper system, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
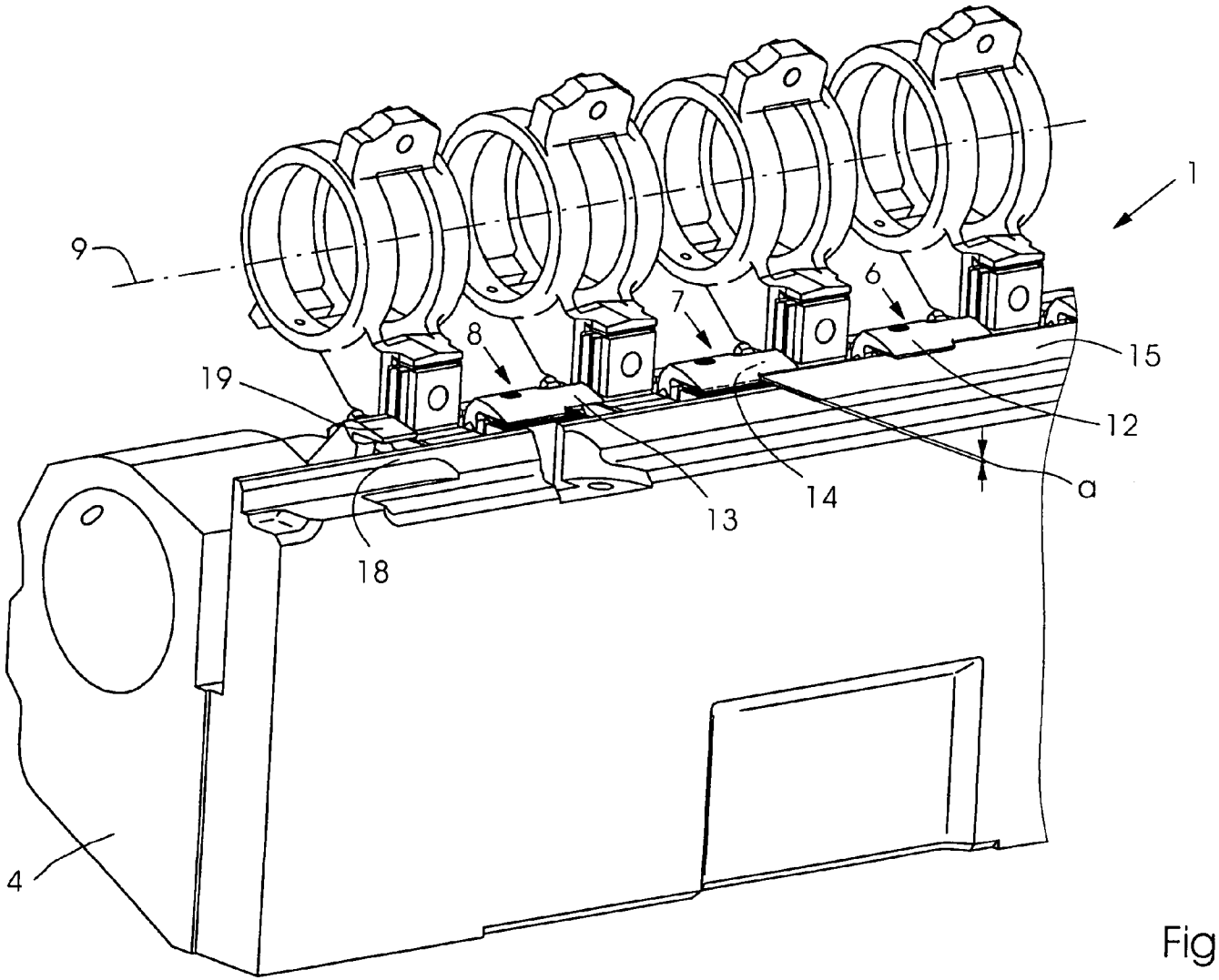
FIG. 1 is a fragmentary, perspective view of a portion of a first gripper system according to the invention.

Referring now to the figures of the drawings in detail and first, particularly to FIG. 1 thereof, there is shown a detail of a machine 1. The machine 1 is, preferably, a sheet-fed printing press. The machine 1 includes a first sheet transport drum 2 and a second sheet transport drum 3, which is illustrated in FIGS. 4 to 7. The first sheet transport drum 2 includes a first gripper system 4, and the second sheet transport drum 3 includes a second gripper system 5, constructed in the same way. The gripper systems 4, 5 are gripper bars.

The first gripper system 4 includes grippers 6, 7, 8 that are disposed in a row and that are seated on a gripper shaft 9 that is illustrated purely schematically in FIG. 1 by using its geometric axis of rotation. The gripper shaft 9 extends parallel to a mid-axis around which the first sheet transport drum 2 rotates and is used to pivot the grippers 6, 7, 8 toward gripper pads 10 associated with the grippers 6, 7, 8 and away from the pads 10. The grippers 6, 7, 8 are disposed at intervals from one another so that in each case between two immediately adjacent grippers 6, 7 and 7, 8 there is an interspace 11 through which a gripper belonging to the second gripper system 5 passes during the sheet transfer, when the grippers 6, 7, 8 of the first gripper system 4 mesh with the grippers of the second gripper system 5. Each of the grippers 6, 7, 8 has a sheet-clamping surface 12, which lies opposite the respective gripper pad 10, and a hold-down 13, which is formed in one piece with the respective gripper 6, 7, 8.

The hold-downs 13, which extend outside the region of the gripper pads 10 and within the region of the interspaces 11, have the form of small wings that are integrally molded on the grippers 6, 7, 8. Each of the hold-downs 13 is provided with a sheet-supporting surface 14, which extends predominantly outside the region of the respective gripper pad 10 and is located on the same underside of the relevant gripper as the sheet-clamping surface 12 of the latter. The sheet-supporting surfaces 14 are configured to be set back from the sheet clamping surfaces 12 by a distance a amounting to 0.5 to 1.5 mm, preferably, about 1 mm and, for example, 1.1 mm, so that, in the case of disruption-free sheet transport, a printing material sheet 15 held clamped in by the grippers does not even make contact with a single one of the sheet supporting surfaces 14 forming these offsets.

The printing material sheet 15 has a sheet width that is less than the largest possible sheet format that can be processed by the machine 1. The gripper 6 within the row of grippers is, therefore, the last that is able to clamp in the printing material sheet 15. The gripper 7 that is adjacent and located further on the outside within the row of grippers is not able to do this because the sheet-clamping surface of the gripper 7 is located outside the sheet width of the printing material sheet 15. In other words, the printing material sheet 15 is so narrow that it no longer reaches as far as the gripper pad 10 and the sheet clamping surface of the gripper 7 interacting with the latter and, instead, has an unclamped, lateral sheet edge 16 that runs out in the region of the interspace 11 in what is referred to as a free sheet corner 17.

If suitable countermeasures were not taken, because of the static air pressure and the centrifugal force that act on the free sheet edge 17, the free sheet edge 17 could break out downward, that is to say, toward the first sheet transport drum 2, or upward, that is to say, away from the first sheet transport drum 2. The tendency of the sheet corner 17 to bend downward or upward is greater when the printing material sheet 15 material is thinner and more flexible and when the free projecting length of the printing material sheet 15 is further from the gripper 6 toward the gripper 7. With increasing printing speed and rotational speed of the first sheet transport drum 2, and, thus, with increasing transport speed of the printing material sheet 15, the centrifugal force acting on the sheet corner 17 and the static air pressure acting on the sheet corner 17 increase, and, thus, the tendency of the sheet corner 17 to break out upward or downward is increased.

To prevent such movement, countermeasures are taken in the form of the hold-downs 13 and a supporting rail 18 integrally molded on the first gripper system 4. The supporting rail 18, as viewed in the sheet transport direction, extends immediately behind the gripper pads 10 and interspaces 11 and at a distance b relative to the gripper pads 10 underneath the latter. In the fault-free state, that is to say, given a flat position of the sheet corner 17, the printing material sheet 15 makes no contact at all with the supporting rail 18, because of the distance b. The printing material sheet 15 comes into contact with the supporting rail 18 only when the sheet corner 17 has been bent downward, on account of the aforementioned interfering variables, to a specific extent but that is still tolerable. The distance b is dimensioned such that a collision of the sheet corner 17, in its state bent downward, with the second gripper system 5 is reliably avoided. Of course, it is also conceivable, instead of the supporting rail 18, to provide a row of supporting elements, of which each would, then, be located behind another of the interspaces 11.

To avoid such a collision of the sheet corner 17 also in its possibly upwardly bent state, the hold-down 13 on the gripper 7 is provided. Because of its distance a, the sheet supporting surface 14 of the hold-down 13, covering the sheet corner 17 from above, likewise comes into contact with the sheet supporting surface 14 only in the event of a disruption, that is to say, when the sheet corner 17 is erected to an extent that is still tolerable. The sheet-supporting surface of 14 is as little a clamping surface as the supporting surface of the supporting rail 18. The two supporting services are, rather, stop surfaces that limit undesired movements of the printing material sheet 15 and with which there is no contact at all with the printing material sheet 15 during the fault-free transport of the latter.

Because the gripper 7 is connected flexibly to the gripper shaft 9 by a spring, the hold-down 13 disposed laterally on the tip of the gripper 7 is necessarily also spring-mounted. Each of the hold-downs 13 is spring-mounted in this way by the spring of the respective gripper on whose gripper tip the relevant hold-down 13 is disposed.

Figure 2:
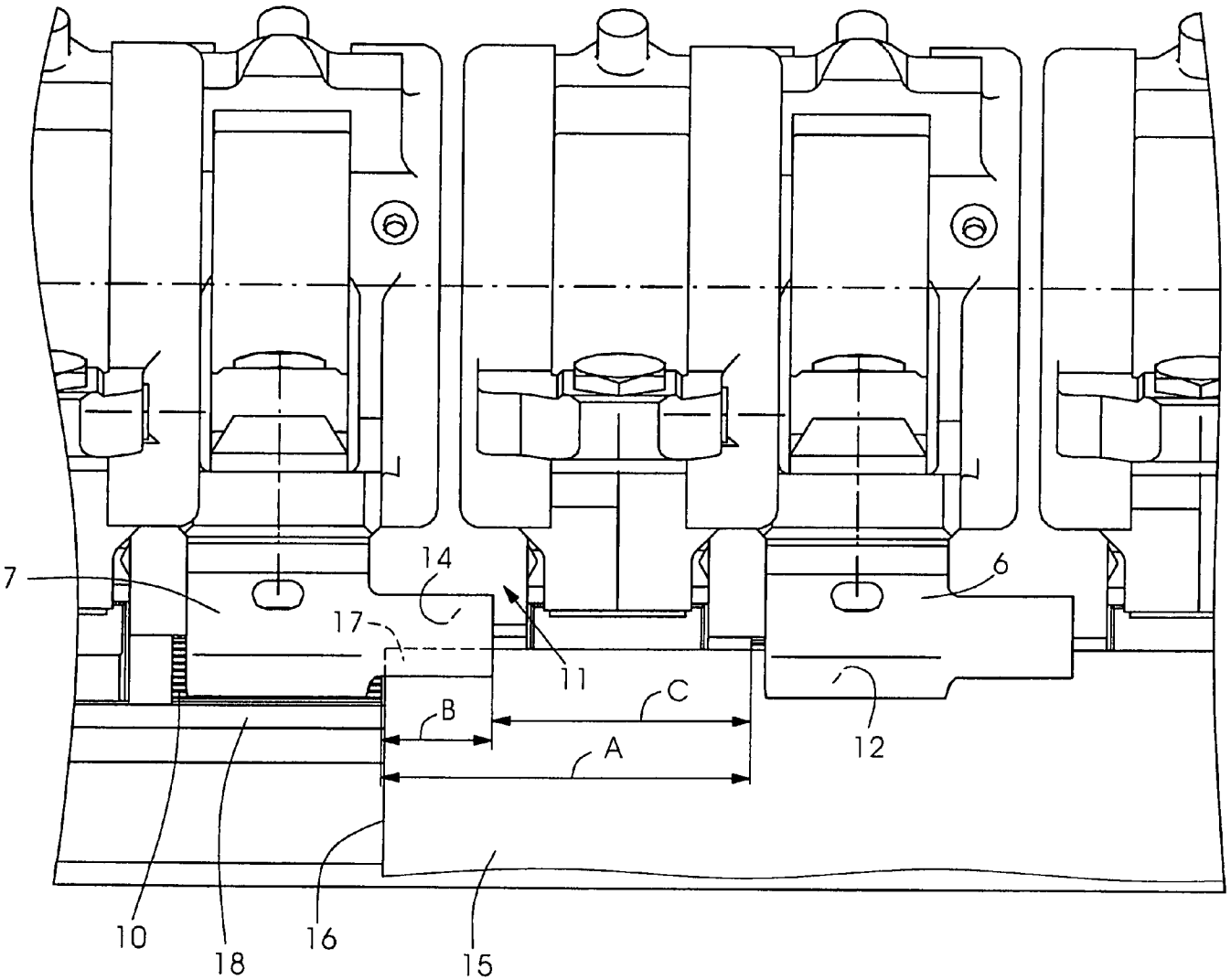
FIG. 2 is a fragmentary, plan view of an enlarged portion the first gripper system of FIG. 1.

As can be seen from FIG. 2, the interspace 11, which is located between the gripper 7 and the gripper pad 10 interacting with the latter on one side, and the gripper 6 and the gripper pad interacting with the latter on the other side, has an overall length A as viewed in the axially parallel direction. The hold-down of the gripper 7 has a projecting length B that, when subtracted from the overall length A, results in a residual length C within the interspace 11. The residual length C, to be measured from the hold-down of the gripper 7 as far as the gripper pad interacting with the gripper 6, is dimensioned to be so great that a gripper belonging to the second gripper system 5 and constructed identically to the grippers 6, 7, 8 can pass through the interspace 11 during the sheet transfer. However, the residual length C is shorter than the length, to be measured in the axially parallel direction, of the gripper passing through the interspace 11, including its hold-down so that this hold-down belonging to the gripper passing through the into interspace 11 and the hold-down of the gripper 7 "travel around" each other during the sheet transfer (cf. FIGS. 4 to 7).

Figure 3:
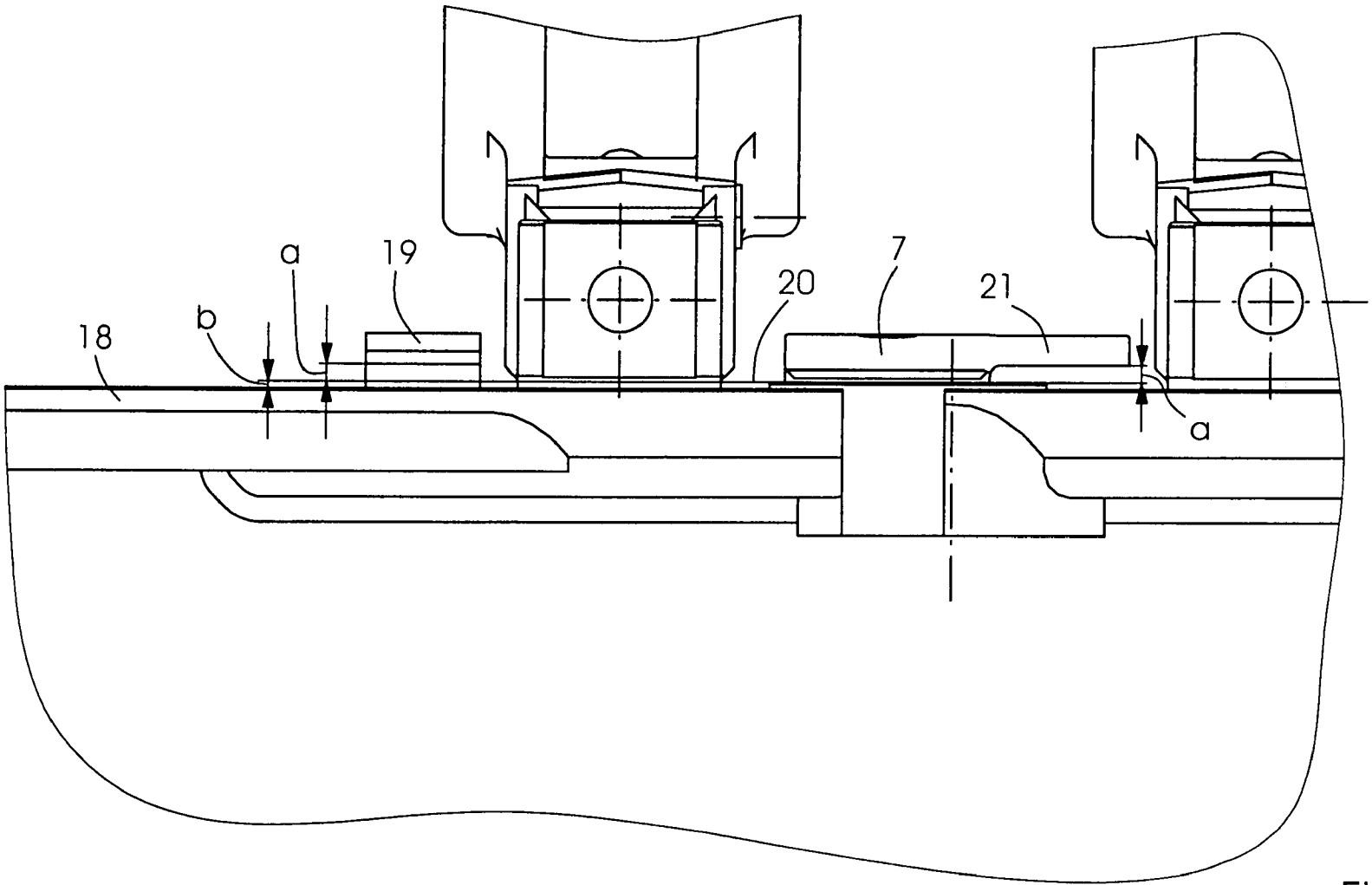
FIG. 3 is a fragmentary, plan view of the first gripper system of FIGS. 1 and 2.

Apart from the hold-downs 13, in each case forming a unit with the grippers 6, 7, 8, the first gripper system 4 has a hold-down 19, acting in the same way as the remaining hold-downs 13, which is disposed separately, that is to say, not on a gripper. The separate hold-down 19 is located at the end of that row that it forms together with the hold-downs 13. Because, as viewed in the axial direction of the first sheet transport drum 2, the gripper 8 is the gripper located furthest on the outside, there is no gripper available on which the separate hold-down 19 located still further outside could have been disposed. The separate hold-down 19 is provided for the purpose of limiting the erection of the free sheet corner of a wide printing material sheet that corresponds to the maximum sheet format and whose free sheet corner would be located under the hold-down 19. As can be seen from FIG. 3, the distance a between the sheet level 20 and the sheet supporting surface of the hold-down 19 is also maintained in the case of the latter. There is, likewise, such a separate hold-down at the end of the row opposite the hold-down 19.

Each of the hold-downs 6, 7, 8, 19, therefore, becomes effective at a different sheet width. Because of the presence of the hold-downs 6, 7, 8, 19, the first gripper system 4 is not only capable of reliably transporting what are referred to as main sheet formats, which are particularly popular and in which the lateral sheet edge 16 is located exactly between one of the grippers 6, 7, 8 and the gripper pad associated with the gripper, but also any sheet format lying in dimensional terms between these main sheet formats. A further advantage of the configuration according to the invention of the hold-downs 13 on the first gripper system 4 is to be seen in the fact that, in the latter, the distance from gripper to gripper can be chosen to be comparatively large and the first gripper system 4, therefore, only needs comparatively few grippers 6, 7, 8 and is, therefore, less expensive to produce than a gripper system having a larger number of grippers.

The printing material sheet clamped in within the gripper system 4 is, advantageously, secured simultaneously from both directions against its sheet corner 17 breaking out upward and downward. On one hand, the sheet corner 17 is secured from above by one of the hold-downs 6, 7, 8, 19 against excessive breaking out or escaping away from the gripper pads. On the other hand, the sheet corner 17 is secured by the supporting rail 18 or one of the supporting elements that can be used instead of the supporting rail 18 against excessive breaking out and bending over downward into the corresponding interspace.

Figure 4:
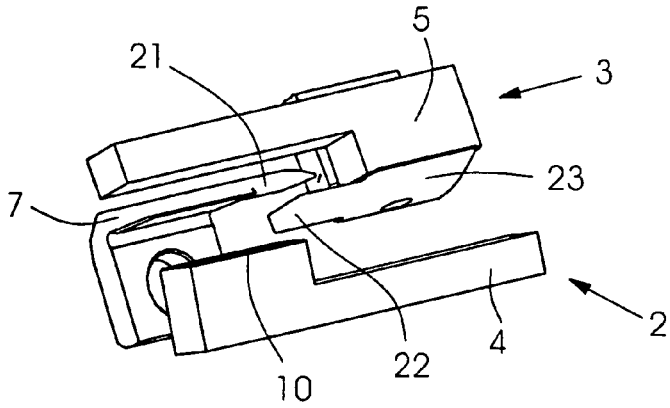
FIG. 4 is a fragmentary, perspective view of one phase sequence of a hold-down of the first gripper system from FIGS. 1 to 3 and a hold-down of a second gripper system.

FIGS. 4 to 7 illustrate, in sequence steps at 10° rotational angles, how the hold-down 21 of the gripper 7, having the sheet supporting surface 14, and the hold-down 22 of the gripper 23 belonging to the second gripper system 5 and passing through the interspace 11 "travel around" each other. FIGS. 4 to 7 correspond to different viewing directions that in each case are best suited to show the interplay of the elements involved in the sheet transfer. In the illustration of the movement sequence of FIGS. 4 to 7, for reasons of better visibility of the elements involved in it, the printing material sheet 15 actually located between the hold-downs 21 and 22 has not also been shown. FIG. 4 shows the gripper systems 4, 5 shortly before the transfer of the printing material sheet from the second gripper system 5 to the first gripper system 4. At such a time, the gripper 23 is closed and the gripper 7 is open, that is to say, lifted off the gripper pad 10.

Figure 5:
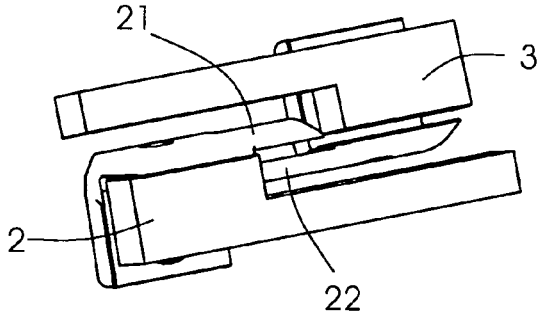
FIG. 5 is a fragmentary, perspective view of another phase sequence of a hold-down of the first gripper system from FIGS. 1 to 3 and a hold-down of a second gripper system.

FIG. 5 illustrates the moment of the transfer of the printing material sheet, the sheet supporting surface of the hold-down 21 of the first gripper system 4 and the first sheet transport drum 2, and the sheet supporting surface of the hold-down 22 of the second gripper system 5 and the second sheet transfer drum 3 lying opposite one another in parallel planes.

Figure 6:
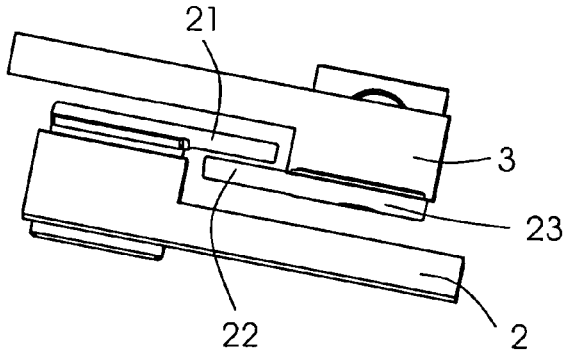
FIG. 6 is a fragmentary, perspective view of a further phase sequence of a hold-down of the first gripper system from FIGS. 1 to 3 and a hold-down of a second gripper system.

In FIG. 6, the gripper systems 4, 5 are shown shortly before the transfer of the printing material sheet, FIG. 6 revealing that, at this time, the gripper 7 is already closed and the gripper 23 is open, that is to say, is lifted off the gripper pad associated with it. The printing material sheet 15 already clamped in between the gripper 7 and the gripper pad 10 in this case is not also illustrated in FIG. 6, as already stated above.

Figure 7:
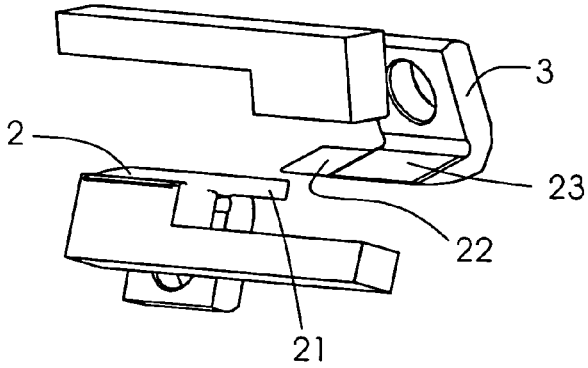
FIG. 7 is a fragmentary, perspective view of yet another phase sequence of a hold-down of the first gripper system from FIGS. 1 to 3 and a hold-down of a second gripper system.

In FIG. 7, the sheet transport drums 2, 3 are illustrated in a rotational angle position that follows the rotational angle positions shown in FIG. 6 and in which the hold-down 21 and the other hold-downs of the first sheet transport drum 2 already no longer overlap the hold-down 22 and the remaining hold-downs of the second sheet transport drum 3.

We claim:

1. A gripper system, comprising: grippers disposed in a row, said grippers defining interspaces therebetween and having sheet clamping surfaces and hold-downs for respectively holding down a free edge of a printing material sheet gripped by said grippers, said hold-downs being disposed to project into said interspaces and being mounted to adjust together with said grippers when gripping the printing material sheet, and said hold-downs having sheet supporting surfaces disposed to be offset away from said sheet clamping surfaces in a direction at right angles to said row.

2. The gripper system according to claim 1, wherein said hold-downs are disposed on said grippers.

3. The gripper system according to claim 2, wherein each of said hold-downs is formed in one piece together with a respective one of said grippers.

4. The gripper system according to claim 1, wherein each of said hold-downs is formed in one piece together with a respective one of said grippers.

5. The gripper system according to claim 1, wherein: said row of said grippers has a row direction; and said sheet supporting surfaces are offset from said sheet clamping surfaces at right angles to said row direction.

6. The gripper system according to claim 5, wherein said sheet supporting surfaces and said sheet clamping surfaces are offset from one another in steps and define planes substantially parallel to one another.

7. The gripper system according to claim 1, wherein said sheet supporting surfaces and said sheet clamping surfaces are offset from one another in steps and define planes substantially parallel to one another.

8. A gripper system, comprising:

grippers disposed in a row, said grippers defining interspaces therebetween and having sheet clamping surfaces and hold-downs for respectively holding down a free edge of a printing material sheet gripped by said grippers, said hold-downs being projecting into said interspaces and adjusting together with said grippers when gripping the printing material sheet, and said hold-down having sheet supporting surfaces disposed to be offset away from said from said sheet clamping surfaces in a direction at right angles to said row.

9. A machine for processing printing material sheets, comprising:

a first gripper system having:

grippers disposed in a row, said grippers defining interspaces therebetween and having hold-downs for respectively holding down a free edge of a printing material sheet gripped by said grippers, said hold-downs being disposed to project into said interspaces and being mounted to adjust together with said grippers when gripping the printing material sheet; and a second gripper system having second grippers disposed in a row, said second grippers defining second interspaces therebetween and having second hold-downs for respectively holding down a free edge of a printing material sheet gripped by said second grippers, said second hold-downs being disposed to project into said second interspaces and being mounted to adjust together with said second grippers when gripping the printing material sheet, said first and second gripper systems being disposed to transfer and accept the printing material sheets from one to the other during sheet transfers.

10. The machine according to claim 9, wherein said hold-downs have sheet supporting surfaces;

said second hold-downs have second sheet supporting surfaces; and said sheet supporting surfaces face said second sheet supporting surfaces during the sheet transfers.

11. The machine according to claim 9, further comprising a sheet transport drum, said first gripper system being a part of said sheet transport drum.

12. The machine according to claim 11, further comprising a second sheet transport drum, said second gripper system being a part of said second sheet transport drum.

13. The machine according to claim 12, wherein said machine is a sheet-fed printing press.

14. A machine for processing printing material sheets, comprising:

a first gripper system having:

grippers disposed in a row, said grippers defining interspaces therebetween and having sheet clamping surfaces and hold-downs for respectively holding down a free edge of a printing material sheet gripped by said grippers, said hold-downs projecting into said interspaces and adjusting together with said grippers when gripping the printing material sheet, and said hold-downs having sheet supporting surfaces disposed to be offset away from said sheet clamping surfaces in a direction at right angles to said row; and a second gripper system, said first and second gripper systems being disposed to transfer and accept the printing material sheets from one to the other during sheet transfers.

15. The machine according to claim 14, wherein said second gripper system has second grippers disposed in a row, said second grippers defining second interspaces therebetween and having second hold-downs for respectively holding down a free edge of a printing material sheet gripped by said second grippers, said second hold-downs being disposed to project into said second interspaces and being mounted to adjust together with said second grippers when gripping the printing material sheet.

16. The machine according to claim 15, wherein said second hold-downs have second sheet supporting surfaces; and said sheet supporting surfaces face said second sheet supporting surfaces during the sheet transfers.

17. The machine according to claim 14, further comprising a sheet transport drum, said first gripper system being a part of said sheet transport drum.

18. The machine according to claim 14, further comprising, a second sheet transport drum, said second gripper system being a part of said second sheet transport drum.

19. The machine according to claim 14, wherein said machine is a sheet-fed printing press.

* * * * *